US006675555B1

(12) United States Patent
Monti

(10) Patent No.: US 6,675,555 B1
(45) Date of Patent: Jan. 13, 2004

(54) UNIT FOR FEEDING ARTICLES TO A BLISTER BAND

(75) Inventor: Giuseppe Monti, Pianoro (IT)

(73) Assignee: Marchesini Group S.p.A., Bologna (IT)

( * ) Notice: Subject to any disclaimer, the term of this patent is extended or adjusted under 35 U.S.C. 154(b) by 6 days.

(21) Appl. No.: 10/210,407

(22) Filed: Aug. 1, 2002

(51) Int. Cl.[7] ..... B65B 17/00

(52) U.S. Cl. ..... 53/167; 53/559; 53/561; 53/201; 53/281

(58) Field of Search ..... 53/559, 561, 201, 53/281, 282; 221/46, 197; 206/531, 532

(56) References Cited

U.S. PATENT DOCUMENTS

| | | | | | |
|---|---|---|---|---|---|
| 3,574,270 | A | | 4/1971 | Rosendahl | |
| 3,874,143 | A | * | 4/1975 | Braber | 53/412 |
| 3,946,537 | A | * | 3/1976 | Hair et al. | 53/559 |
| 4,012,888 | A | | 3/1977 | Nichols | |
| 4,233,801 | A | * | 11/1980 | Watt | 53/453 |
| 4,490,963 | A | * | 1/1985 | Knudsen | 53/559 |
| 4,506,495 | A | * | 3/1985 | Romagnoli | 53/559 |
| 4,750,318 | A | * | 6/1988 | Matsuzawa | 53/559 |
| 4,975,015 | A | * | 12/1990 | Harding | 414/412 |
| 5,329,750 | A | * | 7/1994 | Bagley et al. | 53/559 |
| 5,460,471 | A | * | 10/1995 | Connor et al. | 414/412 |
| 5,509,773 | A | * | 4/1996 | Connor et al. | 414/412 |
| 6,311,743 | B1 | * | 11/2001 | Baroncini | 141/234 |
| 6,357,495 | B1 | * | 3/2002 | Baroncini | 141/185 |
| 6,397,915 | B1 | * | 6/2002 | Amaranti et al. | 156/504 |
| 6,439,426 | B1 | * | 8/2002 | Baroncini | 221/241 |
| 6,494,022 | B1 | * | 12/2002 | Aylward | 53/473 |

FOREIGN PATENT DOCUMENTS

| | | |
|---|---|---|
| EP | 1 170 213 A1 | 1/2002 |
| GB | 2 281 245 A | 3/1995 |
| WO | 00 24635 A | 5/2000 |

* cited by examiner

*Primary Examiner*—Rinaldi L. Rada
*Assistant Examiner*—Hemant M. Desai
(74) *Attorney, Agent, or Firm*—William J. Sapone; Coleman Sudol Sapone, P.C.

(57) ABSTRACT

In a unit for feeding articles to a blister band, a casing has two apertures for a blister band to enter and come out of the casing. The casing supports and contains operative means for feeding articles to blisters made in the blister band. The casing is connected to a blistering machine for feeding the articles, and is removed from the blistering machine for cleaning and/or sterilizing the casing and the operative means in a suitable area.

8 Claims, 3 Drawing Sheets

UNIT FOR FEEDING ARTICLES TO A BLISTER BAND

BACKGROUND OF THE INVENTION

The present invention relates to articles into the blisters of a blister band to produce blister packs. More precisely, the present invention relates to a unit for feeding articles to the blister band.

DESCRIPTION OF THE PRIOR ART

Automatic blistering machines are known in the prior art, which produce blister packs from a band of a heat-formable material.

The machines form a regular plurality of blisters on the heat-formable band and fill them with relative articles; then, the blisters are closed hermetically by a sealing film associated to the blister band.

More precisely, the known blistering machines include, arranged in a line, a station where one or more bobbins of heat-formable band are disposed, a station for heat forming the band unwinding from the bobbin being used, a station for feeding articles to the blister band, a station for checking the presence of articles in the blisters of the band, a station for sealing blister band and a station, where the blister band is cut to obtain single blister packs.

Then, the blister packs are sent to a packaging machine.

The feeding station of the above mentioned machines needs to be cleaned during the size changeover or when the type of articles to be packaged is changed.

During the machine operative steps, fragments of articles are in fact released in the feeding station and must be accurately removed to avoid any contamination of subsequent packs.

Obviously, in case of the size changeover, the operative means must be substituted and the common parts need to be cleaned; in case the articles type is changed maintaining the size, all means of the feeding station must be cleaned.

Cleaning of the articles feeding station is a critical operation performed on the blistering machine.

Actually, the machine must be stopped, obviously affecting the production rate. Moreover, expensive manpower is required.

SUMMARY OF THE INVENTION

The object of the present invention is to resolve the above problem by proposing a unit for feeding articles to a blister band in a blistering machine, which is easy to clean in an environment different than the machine processing environment.

Another object of the present invention is to propose a feeding unit, whose shape allows to speed up the size changeover.

A further object of the present invention is to prevent powders and/or fragments produced by the articles from spreading into the machine environment.

A still further object of the present invention is to propose a unit which fulfills the above objects without affecting the production rate and functionality of the blistering machine.

In accordance with the invention, the unit for feeding article to a blister band is defined by the features of the independent claim, while preferred features are defined in the dependent claims.

BRIEF DESCRIPTION OF THE DRAWINGS

The invention will now be described in more detail with reference to particular, non-limiting embodiments and with reference to the accompanying drawings, in which.

DESCRIPTION OF THE PREFERRED EMBODIMENTS

Figure 1:
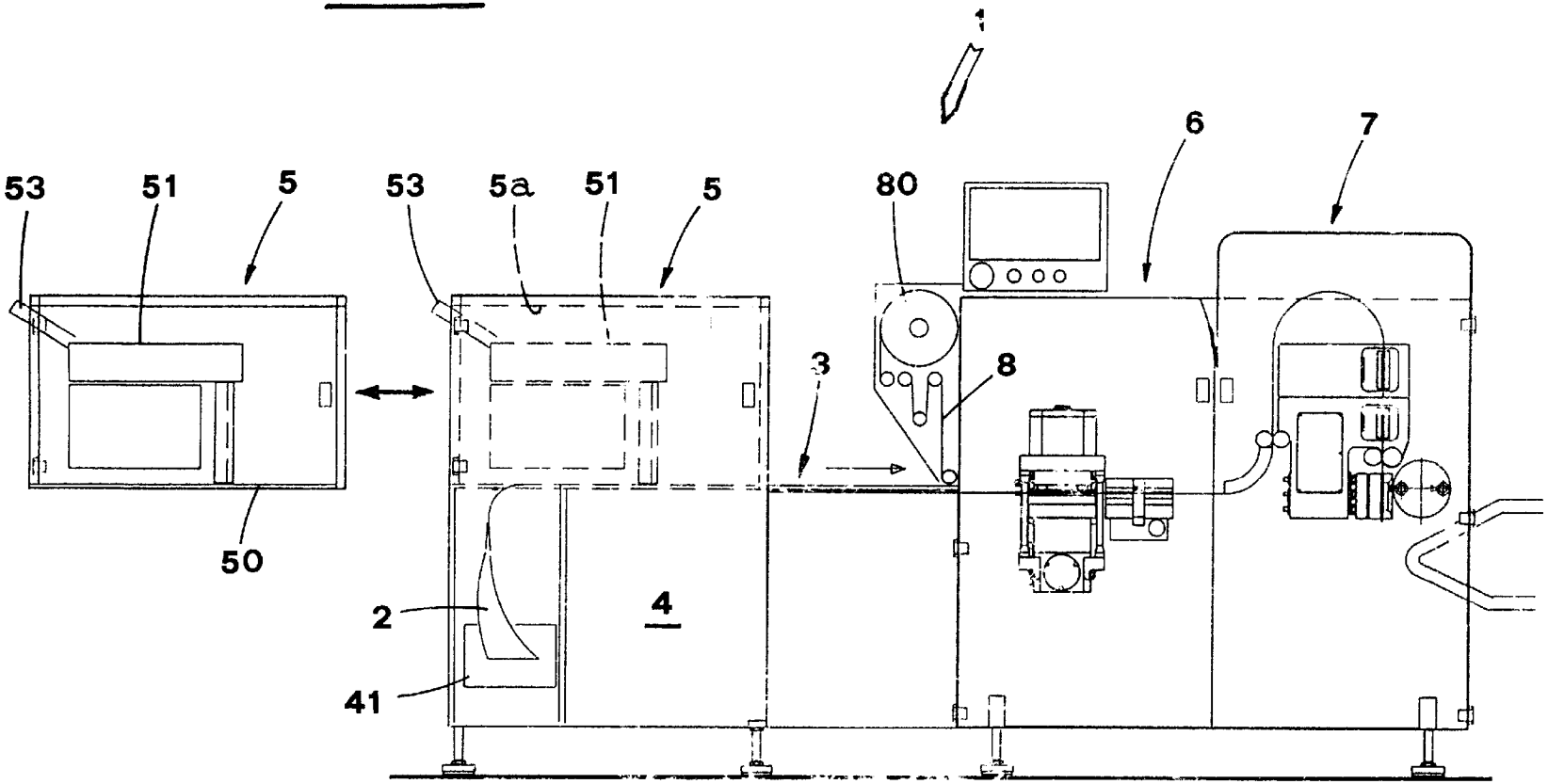
FIG. 1 is a front view of a blistering machine equipped with the proposed feeding unit.
Figure 3:
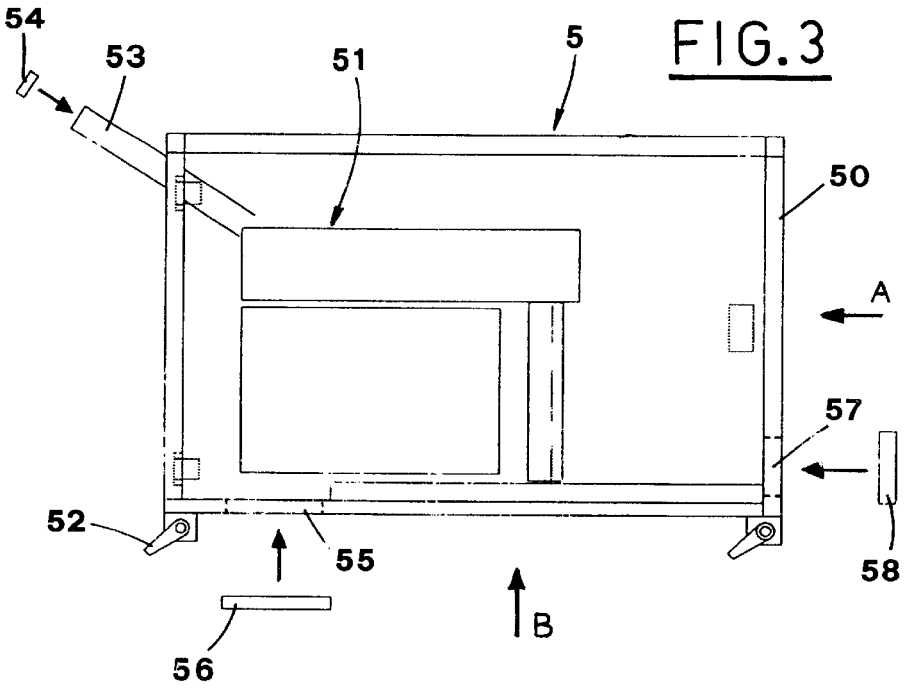
FIGS. 2 and 3 are top and front views, respectively, of the proposed unit for feeding articles.

With reference to the above Figures, the reference numeral 1 indicates a machine for producing blisters.

The blistering machine 1 includes a series of modular units, which are to be suitably connected to each other, as better described in Italian patent application Ser. No. BO2000A 000401 filed by the same Applicant.

More precisely, the blistering machine 1 includes a reel holding unit 3, situated preferably in a central position of the machine for holding a bobbin of heat-formable-material band 2.

The band 2, going out of the reel holding unit 3, is conveyed to a heat-forming unit 4, situated downstream of the loading unit 3 and arranged in line therewith, where a regular series of blisters is formed on the band 2 of heat-formable material.

The so obtained blister band is deflected downward and then turned crosswise in correspondence to a folding member 41.

The blister band 2 going out of the heat-forming unit 4, is conveyed to a unit 5 for feeding articles 10 aimed at filling the blisters of the blister band.

The feeding unit 5 is situated beside the heat-forming unit 4 and at a higher level, i.e. situated in correspondence to the upper part of the unit 4.

The feeding unit 5 is suitably removable from the machine, as seen in FIG. 1, where the broken line 5*a* indicates the assembling position of the unit 5.

The blister band 2 filled with the articles is then conveyed to a sealing unit 6, where the blisters are closed with a suitable sealing band 8.

The sealing band 8 unwinds from a bobbin 80 loaded on the sealing unit 6.

Finally the sealed band 2 is conveyed to a sharing unit 7, where it is cut to obtain single blister packs.

The feeding unit 5 includes a substantially box-like casing 50, inside which operative means 51 of known type are situated.

The casing 50 includes suitable means 52 for rapid fixing thereof to the machine structure, in the region of the heat-forming unit 4.

The upper part of the feeding unit 5 includes articles inlet channel 53, suitably inclined, so as to carry the articles to the above mentioned operative means 51.

The inlet channel 53 is closed from outside by a cover 54.

The feeding unit 5 includes also a lower entering aperture 55 to allow the blister band 1 to be introduced into the feeding unit 5 and a lateral exiting aperture 57 to allow the blister band 2 to go out.

In assembly configuration, the lower entering aperture 55 faces a corresponding aperture of the heat-forming unit 4.

The apertures 55 and 57 are closed by covers 56, 58, respectively.

Therefore, during the machine normal operation, the feeding unit 5 allows the blister band 2 to transit thereinside and lets in the articles 10 for filling the blisters of the blister band 2.

When the articles size or type is to be changed, the feeding unit 5 is removed from the structure 100 of the blistering machine by releasing the rapid fixing means 52, after feeding of the articles 10 and of the blister band 2 to the feeding unit 5 has been interrupted.

Thus, it is possible to remove the feeding unit 5 for cleaning and substitute it with a similar clean feeding unit, obviously adapted for the new size or the new type of articles to be packaged, as shown in schematic way in FIG. 1.

The above operation does not create any diffusion of powders or fragments produced by the articles 10, as it is performed within the casing 50.

Figure 2:
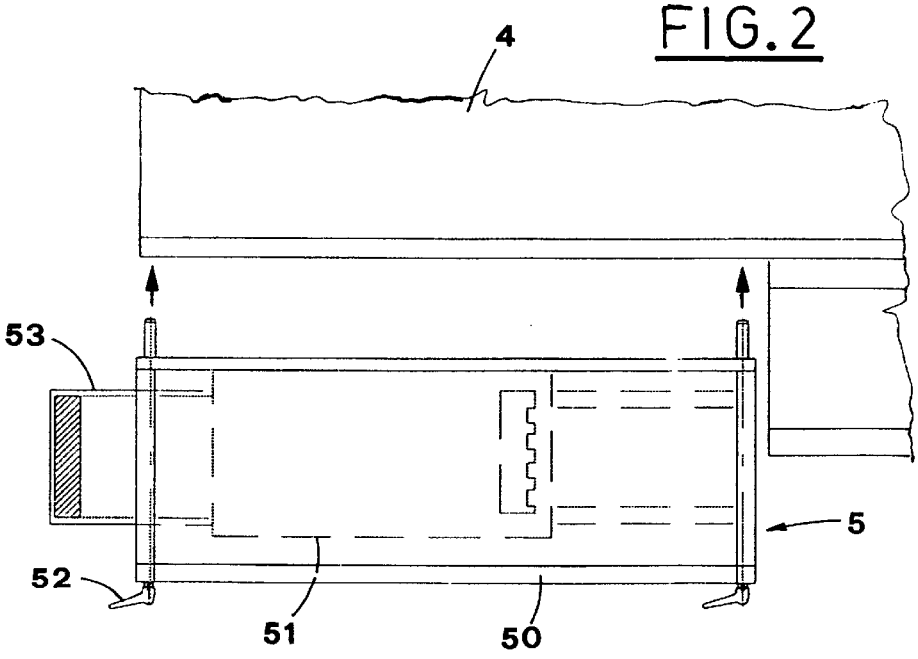

The clean feeding unit is connected rapidly to the machine structure by the rapid fixing means 52 (see FIG. 2), which allows to resume the production immediately, with obvious advantages for the equipment production.

The removed feeding unit is brought to the cleaning area, which is separated from the machine area.

The unit can be cleaned easily, in particular e.g. sterilizing the whole unit, without causing any long down time.

Figure 4B:
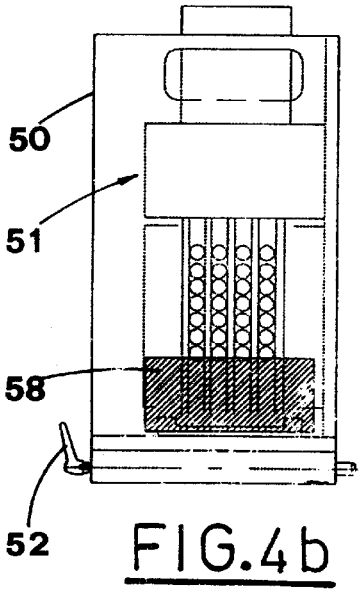
FIGS. 4*a* and 4*b* are lateral views of the feeding unit, along the direction indicated with arrow A in FIG. 3, in opening and closing configurations, respectively.
Figure 4A:
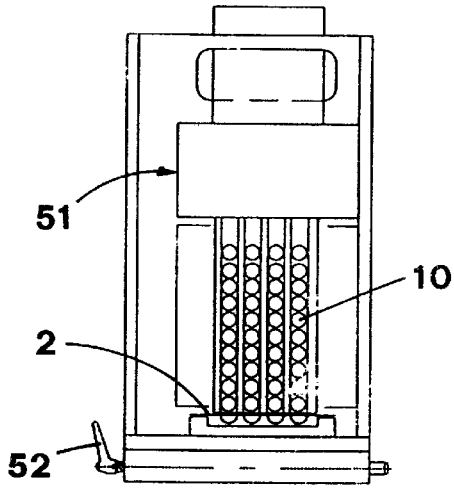
Figure 5:
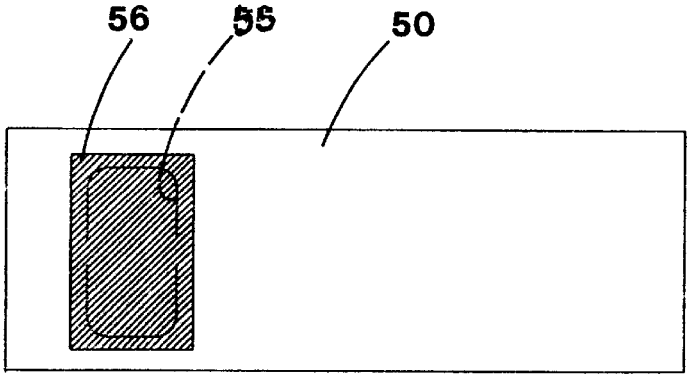
FIG. 5 is a bottom view of the proposed feeding unit, along the direction indicated with arrow B in FIG. 3.

After the cleaning has been completed, the casing of the feeding unit is closed hermetically by the covers 54, 56 and 58, situated respectively at the inlet of the articles feeding channel 53 and on the apertures 55, 57, through which the blister band 2 passes (FIGS. 4*b* and 5), so as to keep the feeding unit clean.

Afterwards, the cleaned feeding unit is placed in a suitable area until it is needed for next substitution.

Therefore, the proposed unit for feeding articles can be cleaned in a simple way.

Actually, due to the fact that the feeding unit can be removed from the machine structure, the cleaning operations can be performed outside the machine area, without affecting with the machine operation.

What is claimed is:

1. A unit for feeding articles to a blister band provided with blisters for receiving said articles, the feeding unit being designed for operation on a blistering machine and including:

a casing;

an entering aperture made in said casing for allowing entering of said blister band into said casing;

an exiting aperture made in said casing for allowing coming out of said blister band from said casing;

operative means supported and contained within said casing for feeding said articles to said blisters of said blister band, said casing being connected, along with said operative means, to said blistering machine, for feeding said articles to said blisters of the blister band, and removed from the blistering machine, for cleaning and/or sterilizing said casing and said operative means in a suitable area.

2. A unit according to claim 1, wherein said casing supports at top a channel for feeding said articles to said operative means.

3. A unit according to claim 1, wherein said entering aperture is made in a lower wall of said casing.

4. A unit according to claim 1, wherein said exiting aperture is made in a lateral wall of said casing.

5. A unit according to claim 1, wherein said casing includes means for rapid fixing to said blistering machine.

6. A unit for feeding articles to a blister band provided with blisters for receiving said articles, the feeding unit being designed for operation on a blistering machine equipped with a heat-forming unit for heat-forming said blisters on said band, and the feeding unit including:

a casing;

an entering aperture made in said casing for allowing entering of said blister band into said casing;

a coming out aperture made in said casing for allowing coming out of said blister band from said casing;

operative means supported and contained within said casing for feeding said articles to said blisters of said blister band, said casing being connected, along with said operative means, to said blistering machine, for feeding said articles to said blisters of the blister band, and removed from the blistering machine, for cleaning and/or sterilizing said casing and said operative means in a suitable area; and said entering aperture being made in a lower wall of said casing, so that when the casing is mounted onto the machine, said entering aperture faces a corresponding aperture made in said heat-forming unit.

7. Unit, according to claim 6, wherein said exiting aperture is made in a lateral wall of said casing.

8. A unit according to claim 6, wherein said casing includes means for rapid fixing to said blistering machine in correspondence to said heat-forming unit.

* * * * *